US005643154A

United States Patent [19]

Awbrey et al.

[11] Patent Number: 5,643,154

[45] Date of Patent: Jul. 1, 1997

[54] WATER AND LAND THERAPY AND FITNESS DEVICE

[76] Inventors: Brian J. Awbrey, 151 Merrimac St., Suite 202; Kipp K. Dye, 151 Merrimac St., Suite 203, both of Boston, Mass. 02114

[21] Appl. No.: 410,718

[22] Filed: Mar. 27, 1995

[51] Int. Cl.[6] ..... A63B 31/00

[52] U.S. Cl. ..... 482/111; 482/146

[58] Field of Search ..... 482/146, 147, 482/148, 55, 79, 80, 111; 472/13, 134, 135

[56] References Cited

U.S. PATENT DOCUMENTS 3,806,116 4/1974 Malmberg et al. ..... 482/147
3,984,100 10/1976 Firster ..... 482/146
4,653,748 3/1987 Seel et al. ..... 482/146
4,848,742 7/1989 Lindley et al. ..... 482/146
4,913,418 4/1990 Schlueter et al. ..... 482/111
5,092,586 3/1992 Tuthill et al. ..... 482/146

*Primary Examiner*—Stephen R. Crow
*Attorney, Agent, or Firm*—Jerry Cohen; Edwin H. Paul

[57] ABSTRACT

A device designed for use on land solely as a rehabilitative balance board apparatus and in water (e.g., a swimming pool) as a rehabilitation and/or fitness apparatus. The invention may be used terrestrially as a proprioception (balance) board and aquatically as a kickboard, as a proprioception (balance) board, and/or as a general exercise board that provides added resistance and/or buoyancy for the exerciser.

4 Claims, 5 Drawing Sheets

WATER AND LAND THERAPY AND FITNESS DEVICE

FIELD OF INVENTION

The present invention relates generally to a rehabilitation and fitness device designed for use in water (e.g., a swimming pool) and as a rehabilitative land device solely used as a balance board. The invention (embodiments of which are hereinafter collectively referred to as the "training board.") is used in the water as a kickboard, as a proprioception (balance) board, or as a general exercise board that provides added resistance and/or buoyancy for the exerciser.

BACKGROUND OF THE INVENTION

The general and continual rise in fitness awareness has led many millions of Americans to appreciate the benefits of exercise. Currently, there is a strong emphasis on muscular toning and cardiovascular conditioning along with injury prevention. Rehabilitation has also been experiencing explosive growth quite parallel to that of the fitness industry. This growth in rehabilitative services is probably due to increased awareness, brought about by the fitness industry, of the importance of health maintenance and injury prevention.

Like the fitness industry, rehabilitation is concerned with muscular toning and cardiovascular enhancement. However, in many musculoskeletal and neuromuscular dysfunctions resulting from traumatic or overuse injury and disease, neuromuscular proprioceptive facilitation of awareness, control, and quality or level of functional capacity and training is a must to aid in the restorative process of impaired joints within the extremities, torso, head, and neck.

SUMMARY OF THE INVENTION

The present invention is a training board that can be used in the water and/or on land as either an exercise board and/or as a balance board. The training board is designed to allow the user to perform many different aquatic exercises for the upper body. An example of an upper body exercise is where the exerciser simply orients the relatively large, flat surface of the board at any angle facing the frontal plane of progression through the water medium (see diagram 1 for clarification). Resistance increases the closer one orients the large flat surface of the board to 90° toward the direction of movement within the water medium, with the theoretical maximum resistance attained when the training board is oriented 90° relative to the direction of movement.

The desired resistance can be selected based on: 1) the speed at which the board is moved through the water; 2) the degree to which the board is submerged; 3) the particular angle that the board is positioned relative to the direction of movement; and 4) the density of the material from which the board is constructed, as this will determine the board's buoyancy or relative density (the comparison between the density of an object to that of the surrounding water).

The training board can also be used for many lower extremity exercises. An example of a lower extremity exercise is one in which the exerciser performs seated bilateral or alternating knee flexion and extension, which enhances strength, coordination, flexibility, and balance to mention just a few benefits of this exercise. The exerciser may hold onto the board while performing this exercise by gripping two handles, which may be formed at either end of the board, or may simply grasp the edges of the board if no handles are provided, depending on the variation of the design.

The significance of the present invention is that it enables both aquatic and land-based exercise and training by healthy individuals and also aquatic and land-based rehabilitative activities by patients in need of such treatment. Accordingly, an object of the present invention is to provide a training board capable of being used both as an aquatic exercise board and/or on land as a balance board.

Another object of the present invention is to provide a training board for use as a flotation aid for therapists, trainers, and aquatic specialists. An example of this particular usage is as a water-walking board, or to have a patient lie supine or prone, depending upon the particular position required for an exercise or series of exercises. The supine position will probably be desired if a patient has a neck or back strain. Injuries other than those which involve the spine can usually tolerate both prone and supine positioning. It is also advantageous to place the training board under the trunk, as this allows the lower extremities to be lower in spatial relationship to the head, trunk, and upper extremities.

It is yet another object of the present invention to provide a buoyant platform for balance training by athletes and exercise enthusiasts, or for the enhancement or re-establishment of the neuromuscular connection called Proprioceptive Neuromuscular Facilitation (PNF) in those who may be injured or congenitally impaired.

The primary object of the present invention is to enhance resistance and balance during water-walking training.

The human body contains multiple proprioceptive sensory organs (MPSOs) which inform the central nervous system of the position or orientation in space of each joint relative to one another. MPSOs also provide various other qualitative and quantitative data elements specific to each joint such as: velocity, rotation, compression, torque, elasticity of the soft tissue surrounding each joint, and the perceived integrity or stability of each joint.

These MPSOs are truly the limiting factor to one's stability during any static or dynamic task. Without the correct functional operation of the MPSOs, one literally loses the ability to perform any movement with safety, control, or grace.

The present invention, when used as a balance training board, generates three innate neurological human neurophysiological responses: 1) righting reactions; 2) balance reactions; and 3) a protective extension response.

Righting reactions involve orienting movements of the head, neck, and body to maintain the eyes horizontal, head vertical, and the body in proper relationship to the head. Stimuli eliciting righting reactions may be optical, labyrinthine, or tactile. Water is a perfect dynamic medium for these stimuli to occur.

Balance reactions are movements that attempt to maintain the center of gravity or buoyancy (C of G or B) within the base of support (B of S). Two examples of such balance reactions are equilibrium-maintenance reactions and proprioceptive reactions. Equilibrium-maintenance reactions are generated in response to changes in the labyrinthine system; proprioceptive reactions are mediated through the more peripheral proprioceptive receptors.

The protective extension response is an extremity movement or combination of movements that changes the B of S if the C of G or B is moved outside of the original B of S.

Applicant has discovered within the art no known training board devices, either for aquatic or land-based exercise or rehabilitation, that meet the objects of the present invention. Balance boards designed solely for land-based clinical use are well-known, but none comprises the elements, features, or uses of the presently claimed invention.

Further objects and advantages of the invention will become apparent from the description of the drawings and the invention, which follow.

DETAILED DESCRIPTION OF THE PREFERRED EMBODIMENTS

Figure 1:
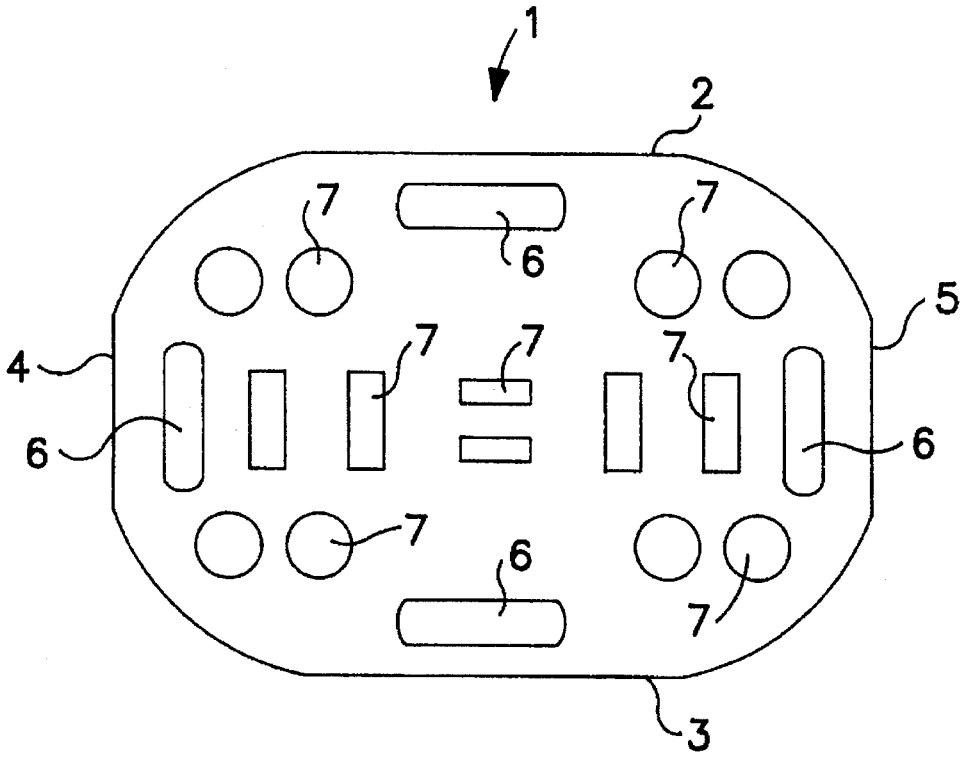
FIG. 1 is a top view of the preferred embodiment of the present invention designed for aquatic use, demonstrating the system of handles and vertical water apertures.
Figure 5:
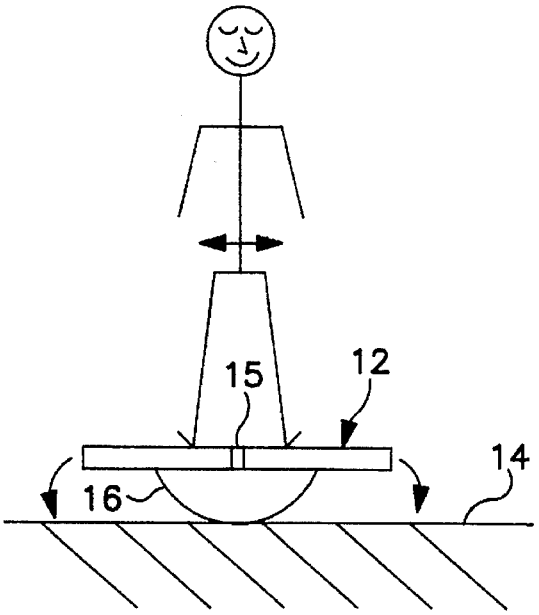
FIG. 5 is a functional representation of the preferred embodiment designed for terrestrial use.

FIG. 1 depicts one embodiment of the training board designed for aquatic use. It is contemplated that the materials used to construct this embodiment of the invention are sufficiently buoyant to support an adult human in the water. The rectangular platform 1 of this embodiment has a top edge 2, a bottom edge 3 and side edges 4 and 5. Two or four apertures 6 are disposed in a centered fashion either along side edges 4 and 5 and/or top edge 2 and bottom edge 3 of rectangular platform 1. These apertures 6 allow the user to grasp the training board on two opposing sides while doing exercises in a standing, or sitting position, as depicted in FIG. 5B, and 5C, respectively. The apertures 6 also allow the user to grasp the training board while in a supine or prone position. A further grouping of both round and rectangular apertures, 7, allow the perpendicular guided flow of water through the training board 1 in a fashion to permit vertical water resistance to applied force of the training board 1.

Figure 2:
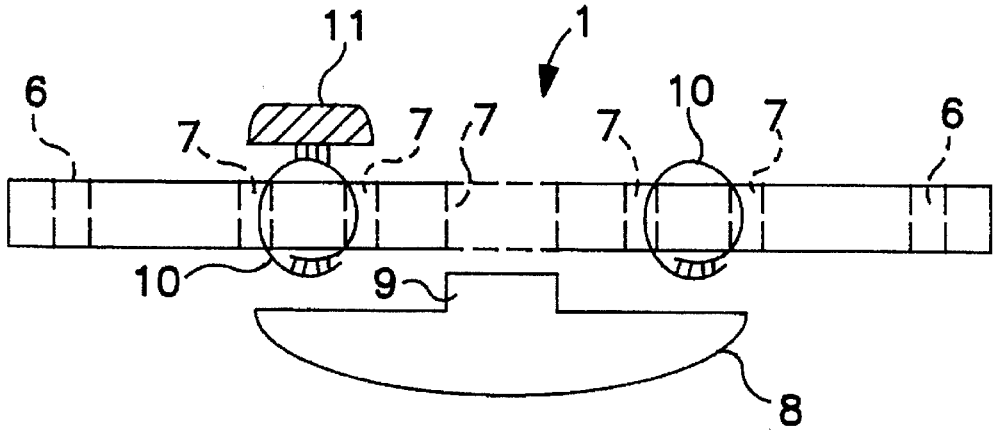
FIG. 2 is a side view of a second embodiment of the present invention designed for both aquatic and terrestrial usage.

FIG. 2 is a hybrid embodiment designed either for terrestrial or aquatic use. This embodiment provides for the attachment of an elliptical modular ballast 8 to a rigid or semi-pliable, non-skid platform 1 having flow-through apertures 7. The ballast 8 can have one or more male components 9 which insert into the flow-through apertures 7. Depending upon whether the use is terrestrial or aquatic, these male components 9 of the ballast 8 are held into place in the platform 1 by either gravity or buoyancy, respectively.

One can insert, in a variety of fashions, straps 10 through the flow-through apertures 7 either to hold modular buoyant flotation cells 11 of varying sizes and/or so that an individual can insert his or her hands or feet through the straps 10. The straps 10 may be of conventional construction or employ hook and eyelet closure. This will allow for more aggressive or faster movements of the training board 1, as the training board will not "slip" away from the user.

Figure 5A:
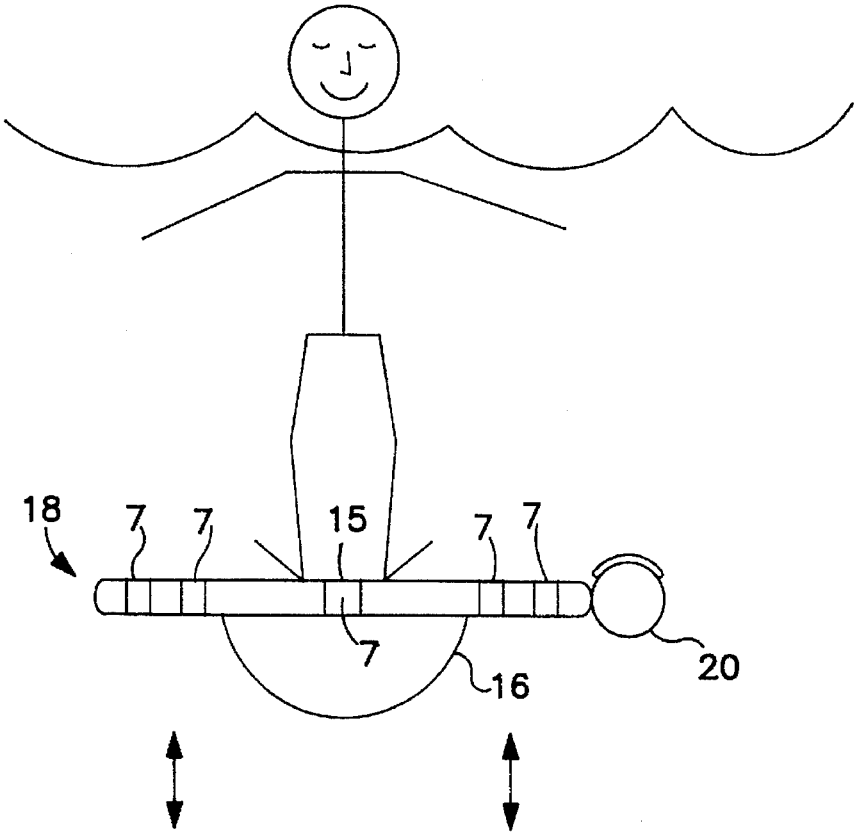
FIGS. 5A–5C are functional representations of the preferred embodiment designed for aquatic use.
Figure 5B:
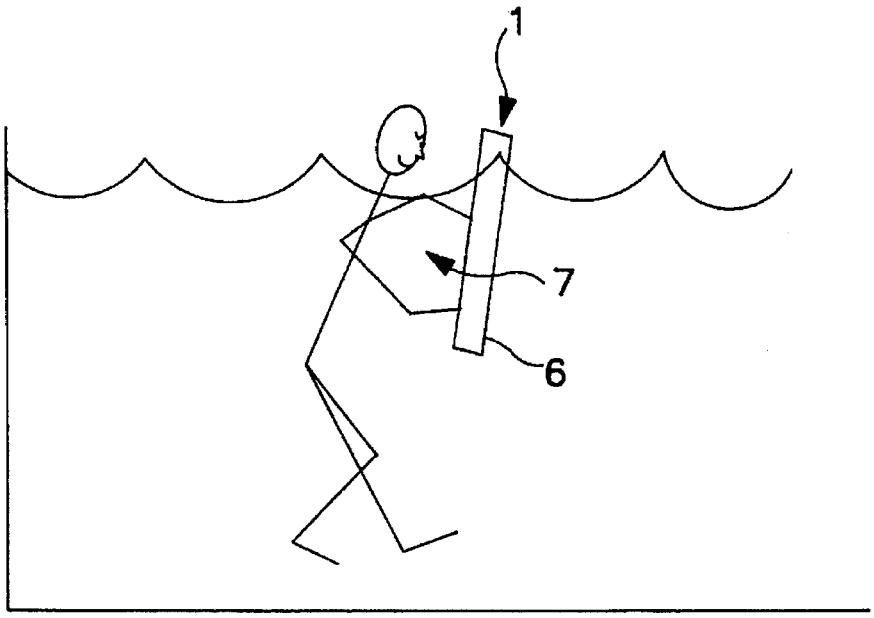
Figure 5C:
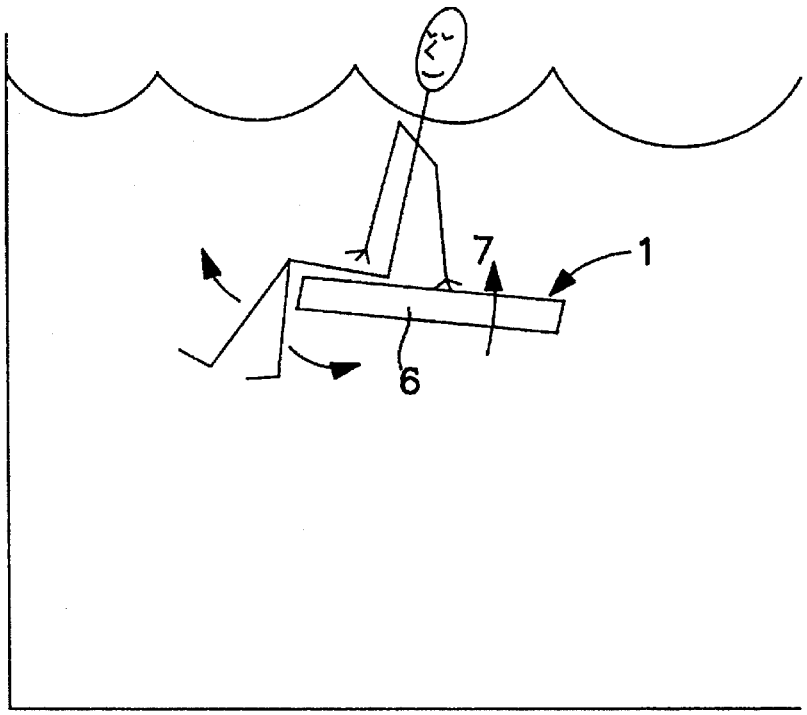

"Squats" are an example of an exercise that may be performed when the feet are secured by the straps 10, as shown in FIG. 5A. While partially submerged, the user first lifts the knees up, thereby drawing the board up (at most two of feet of vertical displacement), then the individual drives the legs down, thereby returning the platform 1 to its original position, whereupon the exercise may be repeated.

One can elect to use a single strap 10 instead of two, thereby attaching only one foot to the platform 1, if the individual wishes to perform one-legged exercises and/or balance training activities. If only one strap 10 is used, it must be centered on the training board 1, to enable the board to stay level throughout the exercise movement.

Figure 3:
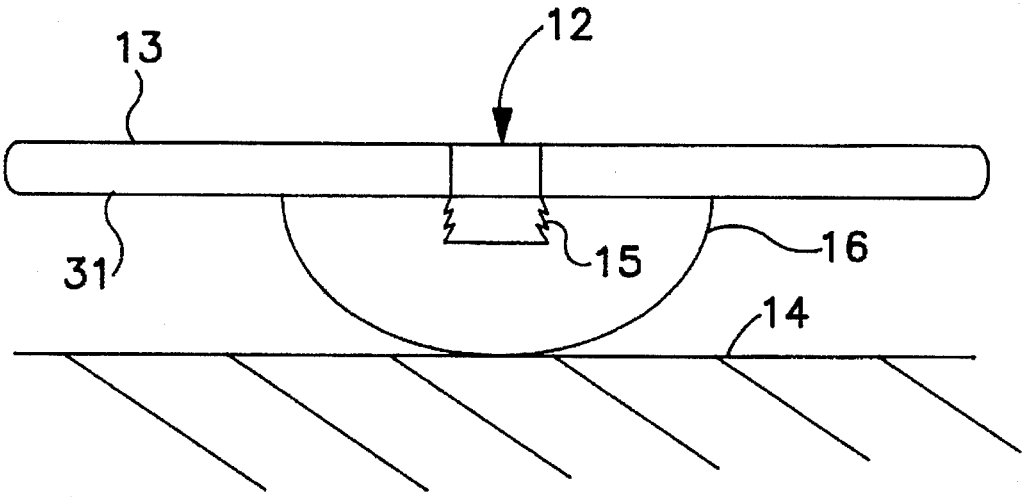
FIG. 3 is a side view of a third embodiment designed for land usage.
Figure 3A:
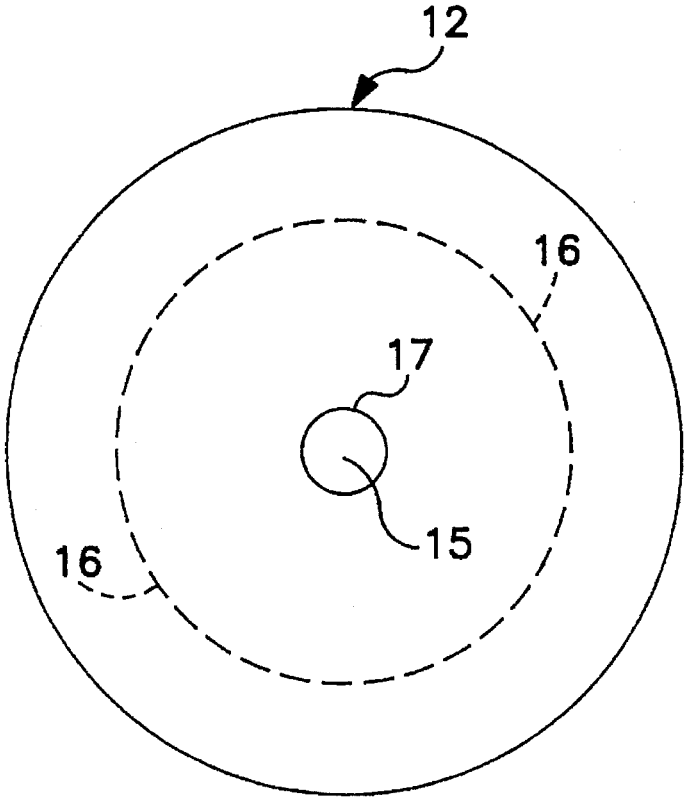
FIG. 3A is a top view of the third embodiment designed for terrestrial use.

FIG. 3 depicts a side view of one embodiment of the training board of the present invention. The board comprises a platform 12 having an upper surface 13 and a lower surface 31. Platform 12 may be of any shape/configuration (e.g., circle, rectangle, oval, square, octagonal). The most practical shape for the platform 12 of this embodiment is circular, as a circle presents a constant circumferential distance between the edge of the platform 12 and the floor 14, as shown in a top view in FIG. 3A. The user of such a board will have proprioceptive and visual feedback of the location of the floor 14 relative to the edge of platform 12 during balance exercise due to the circular configuration. With the acquisition of skill through practice by the user, safety is enhanced by the circular design.

Platform 12 has disposed at its center of gravity either a threaded screw 15 or male component 9, which attaches to the platform 12 a solidly construction yet buoyant modular ballast 16 having either a centered and corresponding threaded female engagement site 17 or male component 9. The ballast 16 can theoretically be any shape, but should be conducive for effective rehabilitation by being symmetrically elliptical and circular without abrupt edges (e.g., hemispherical). Such a configuration allows for safe and effective training or rehabilitation. The connection of the ballast 16 to the platform 12 is achieved either by rotating the centered, corresponding threaded female ballast engagement site 17 onto the threaded screw 15 until the ballast 16 is securely fastened, or fitting the male component 9, onto the lower surface 31 of the platform 12.

This embodiment of the invention can be used both on land and in the water if the materials used to construct the board are buoyant enough to support an adult human in the water, yet strong enough to support the weight of an adult human on land. This embodiment can also be made solely for either land-based or aquatic training, exercise, and rehabilitation.

Figure 4:
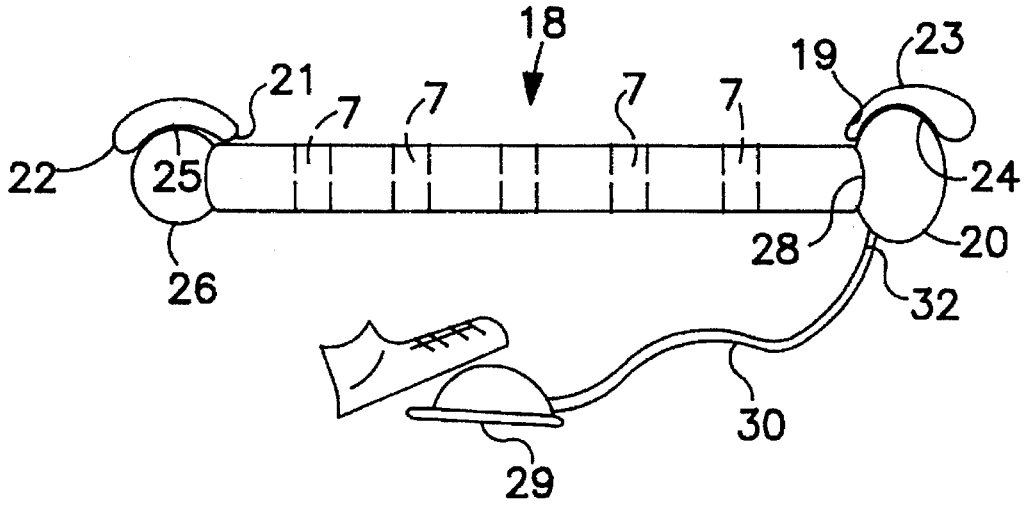
FIG. 4 is a cross-sectional view of a fourth embodiment designed for aquatic use.
Figure 4A:
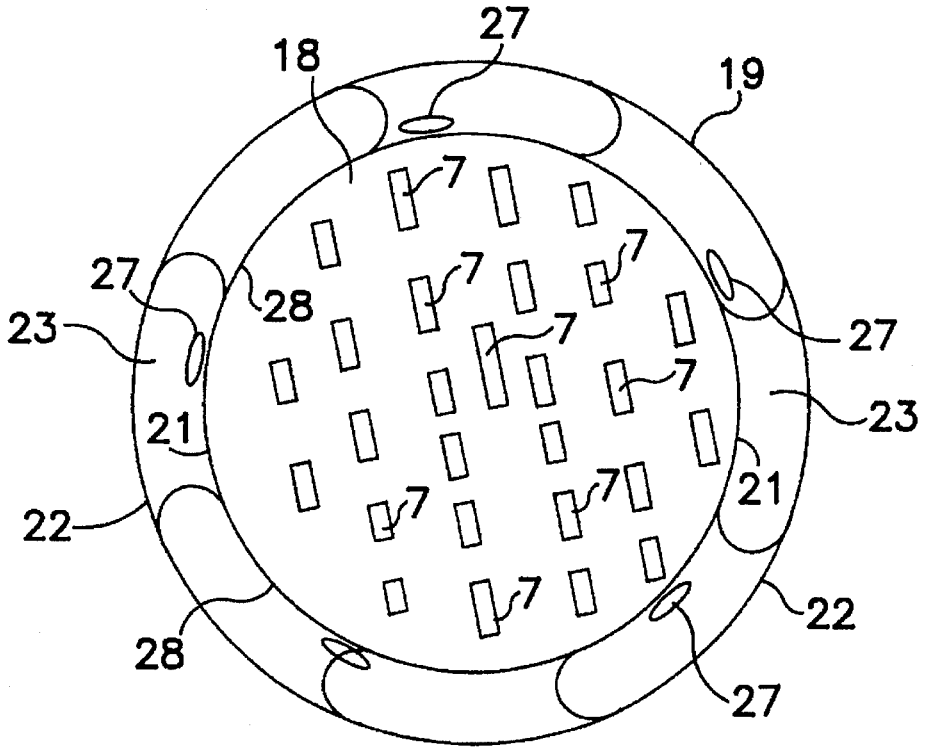
FIG. 4A is a top view of the fourth embodiment designed for aquatic use, demonstrating the vertical water apertures and flotation ring.

FIGS. 4 and 4A depict a possible configuration for a functional, useful, and effective design of a second embodiment specifically designed for aquatic usage. The design, as shown in FIG. 4, contemplates a rigid or semi-pliable non-skid platform 18 having flow-through apertures 7 to minimize shear forces while the user is doing standing exercises that entail the vertical displacement of the board through the water, as indicated by the arrows in FIG. 5A, or the horizontal displacement of the board through the water, as indicated by the arrows in FIG. 5B.

This embodiment also has a rigid cover 19, circular about its periphery and semi-circular in cross-section, and an inflatable, tube 20, circular both about its periphery and in cross-section. The rigid cover 19 has an inner edge 21, an outer edge 22, an upper surface 23 and a lower surface 24. Inflatable tube 20 has a top surface 25 and a bottom surface 26. Both rigid cover 19 and inflatable tube 20 are disposed around the periphery of platform 18, the inner edge 21 of rigid cover 19 being connected by conventional means to the periphery of platform 18.

The purpose of the rigid cover 19 is to maintain a connection between the platform 18 and the inflatable tube 20. This connection may be accomplished by attachment of the top surface 25 of inflatable tube 20 either completely or partially to the bottom surface 24 of rigid cover 19 (e.g., by application therebetween of waterproof or water-resistant adhesive, complementary hook and eye attachment means attached to the lower surface 24 of rigid cover 19 and the upper surface 25 of inflatable tube 20, etc.) or via conventional strap means that are looped through apertures 27 that may be disposed either along the inner edge 24 of rigid cover 19 or along outer edge 28 of platform 18. These conventional strap means would encircle both inflatable tube 20 and rigid cover 19 in the cross-sectional direction.

The inflatable tube 20 can be selectively inflated to allow for the adjustment of buoyancy. This is useful to accommodate humans of different weights, or to allow a user/exerciser to select variable resistance forces. This variability allows for a maximal training benefit and/or progressive rehabilitation for those who are injured or diseased and need to be carefully progressed from less to more resistance as their body becomes stronger.

One can inflate the tube 20 by manually stepping on an air pump 29, which then pushes air through an inflation tube 30 that attaches to the tube stem 32. This system for inflation functions just as a typical bicycle pump. One can even use a bicycle pump to inflate the tube 20.

FIG. 5 is a demonstrable representation of the functional usage of the embodiment of FIG. 3, training board 12. One can also kneel and place the hands, or various other portions of the body, with different positioning for support, on the platform 12 for stabilization and/or balance training. FIG. 5A is a demonstrable representation of the functional usage of the embodiment shown in FIGS. 1 and 3. FIG. 5B is a demonstrable representation of training board 1 for water-walking and FIG. 5C represents use of training board 1 for seated exercise.

The invention may be embodied in other specified forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range or equivalency of the claims are therefore intended to be embraced therein.

What is claimed is:

1. A device for use as an aquatic training board, comprising:

a rigid or semi-pliable, non-skid platform having a periphery, an upper surface, a lower surface, a plurality of flow-through openings therethrough, and at least two handles formed by diametrically opposed disposition about said periphery of at least two apertures capable of accommodating an adult human hand, at least one conventional strap inserted through at least one of said flow-through holes such that an individual can insert at least one hand or foot through said at least one strap, and at least one modular flotation cell attached to said at least one conventional strap.

2. A device designed for use as an aquatic training board wherein said user's weight on said upper surface forces said device into the water, as described in claim 1, further comprising:

a buoyant ballast having an upper attachment surface, a lower hemispherical surface, and at least one male attachment member protruding perpendicularly from said upper attachment surface and shaped to insert correspondingly into at least one of said plurality of flow-through openings in said platform; wherein said ballast is attached to said platform by engagement of said at least one male attachment member with at least one of said plurality of flow-through openings in said platform, the ballast being held in place relative to said platform by the buoyant force of the water against the hemispherical surface.

3. A device as described in claim 1 further comprising:

an inflatable tube attached around said periphery, said tube having a circular cross-sectional dimension, a top surface and a bottom surface, said bottom surface having an inflation nozzle disposed thereon.

4. A device as described in claim 1 further comprising:

an inflatable tube attached around said periphery, said tube having a circular cross-sectional dimension, a top surface and a bottom. surface, said tube having an inflation nozzle disposed thereon.

* * * * *